US009402136B2

(12) United States Patent
Kushima et al.

(10) Patent No.: US 9,402,136 B2
(45) Date of Patent: Jul. 26, 2016

(54) SOUND GENERATOR AND ELECTRONIC APPARATUS USING THE SAME

(71) Applicant: KYOCERA Corporation, Kyoto-shi, Kyoto (JP)

(72) Inventors: Noriyuki Kushima, Kirishima (JP); Shuichi Fukuoka, Kirishima (JP); Takeshi Hirayama, Kirishima (JP); Saneaki Akieda, Nagoya (JP); Atsushi Ishihara, Kirishima (JP); Kentarou Miyazato, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/439,085

(22) PCT Filed: Sep. 27, 2013

(86) PCT No.: PCT/JP2013/076356

§ 371 (c)(1),
(2) Date: Apr. 28, 2015

(87) PCT Pub. No.: WO2014/103454

PCT Pub. Date: Jul. 3, 2014

(65) Prior Publication Data

US 2015/0264489 A1 Sep. 17, 2015

(30) Foreign Application Priority Data

Dec. 28, 2012 (JP) ..... 2012-286793

(51) Int. Cl.
*H04R 25/00* (2006.01)
*H04R 17/10* (2006.01)
(Continued)

(52) U.S. Cl.
CPC ..... *H04R 17/10* (2013.01); *H04R 1/22* (2013.01); *H04R 7/045* (2013.01); *H04R 1/2811* (2013.01); *H04R 31/00* (2013.01); *H04R 2499/11* (2013.01); *H04R 2499/15* (2013.01)

(58) Field of Classification Search
CPC ..... H04R 1/02; H04R 1/025; H04R 1/222; H04R 5/02; H04R 5/023; H04R 5/642; H04R 7/04; H04R 7/06; H04R 7/045; H04R 9/047; H04R 9/06; H04R 15/00; H04R 17/00; H04R 17/005; H04R 17/02; H04R 19/016; H04R 21/02; H04R 2201/023; H04R 2205/021; H04R 2499/11; H04R 2499/15
USPC ..... 381/173, 190, 333, 388, 431
See application file for complete search history.

(56) References Cited

U.S. PATENT DOCUMENTS

2007/0280497 A1* 12/2007 Isberg ..... H04R 1/225 381/345

FOREIGN PATENT DOCUMENTS

JP 58-196797 A 11/1983
JP 04-289897 A 10/1992

(Continued)

OTHER PUBLICATIONS

Shibata, Translation of Japanese Patent Publication 2003/219499, Jul. 31, 2003.*

(Continued)

*Primary Examiner* — Brian Ensey
(74) *Attorney, Agent, or Firm* — Volpe and Koenig, P.C.

(57) ABSTRACT

Provided are a sound generator and an electronic apparatus using the same. The sound generator includes a vibrating body, an exciter that is attached to the vibrating body and bends to vibrate the vibrating body in the thickness direction of the vibrating body by vibrating the exciter itself, an enclosure that is joined to the vibrating body and forms a first space enclosed together with the vibrating body, and a duct that connects between the first space and the external space. A spacing between the vibrating body and the surface of the enclosure facing the vibrating body is smaller than ½ of the length of the wavelength of resonance having the lowest frequency in the bending vibration of the vibrating body.

9 Claims, 4 Drawing Sheets

(51) Int. Cl.

| | |
|---|---|
| ***H04R 7/04*** | (2006.01) |
| ***H04R 1/22*** | (2006.01) |
| *H04R 1/28* | (2006.01) |
| *H04R 31/00* | (2006.01) |

(56) References Cited

FOREIGN PATENT DOCUMENTS

| | | | |
|---|---|---|---|
| JP | 06-138882 | A | 5/1994 |
| JP | 11-205880 | A | 7/1999 |
| WO | 2010/106736 | A1 | 9/2010 |

OTHER PUBLICATIONS

International Search Report, PCT/JP2013/076356, Dec. 24, 2013, 2 pgs.

* cited by examiner

SOUND GENERATOR AND ELECTRONIC APPARATUS USING THE SAME

FIELD

The present invention relates to a sound generator and an electronic apparatus using the same.

BACKGROUND

Conventionally, speakers have been known in which a film of a vibrating body is stretched over a frame and that generate sound by vibrating the vibrating body using a piezoelectric element attached to the vibrating body (see Patent Literature 1, for example).

CITATION LIST

Patent Literature

Patent Literature 1: WO 2010/106736 A1

SUMMARY

Technical Problem

Although the conventional speakers described above can be made thinner, it has been difficult to generate sound having high sound pressure in a wide frequency region.

The present invention is devised in view of such conventional technical problems and aims to provide a sound generator capable of generating sound having high sound pressure in a wide frequency region and an electronic apparatus using the same.

Solution to Problem

A sound generator comprises a vibrating body; an exciter that is attached to the vibrating body and is configured to bend and vibrate the vibrating body in a first direction that is a thickness direction of the exciter by vibrating the exciter itself; an enclosure that is joined to the vibrating body, the enclosure and the vibrating body forming a first space; and a duct that is provided at the enclosure and is configured to connect between the first space and external space, wherein in the first space, a spacing between the vibrating body and a surface of the enclosure facing the vibrating body in the first direction is smaller than ½ of a length of a wavelength of resonance having the lowest frequency in bending vibration of the vibrating body.

An electronic apparatus comprises at least the sound-generator and an electronic circuit that is connected to the sound generator, wherein the electronic apparatus is configured to have a function to generate sound from the sound generator.

Advantageous Effects of Invention

The sound generator of the present invention can generate sound having high sound pressure in a wide frequency region. The electronic apparatus of the present invention can generate sound having high sound pressure in a wide frequency region.

DESCRIPTION OF EMBODIMENTS

Hereinafter, a sound generator and an electronic apparatus using the same that are examples of embodiments of the present invention are described in detail with reference to the accompanying drawings.

First Embodiment

Figure 1:
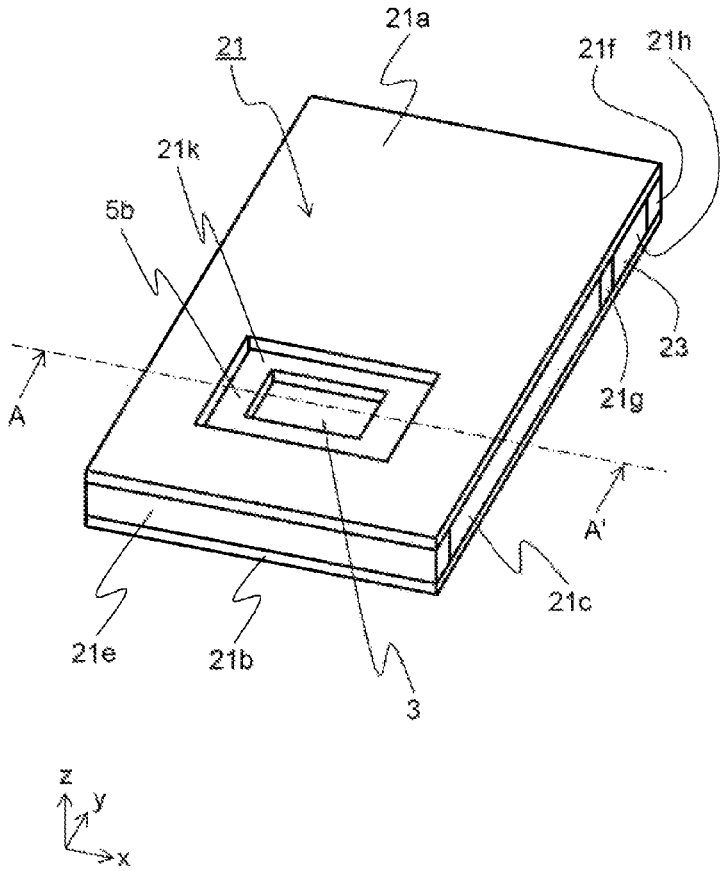
FIG. 1 is a perspective view schematically illustrating a sound generator according to a first embodiment of the present invention.
Figure 2:
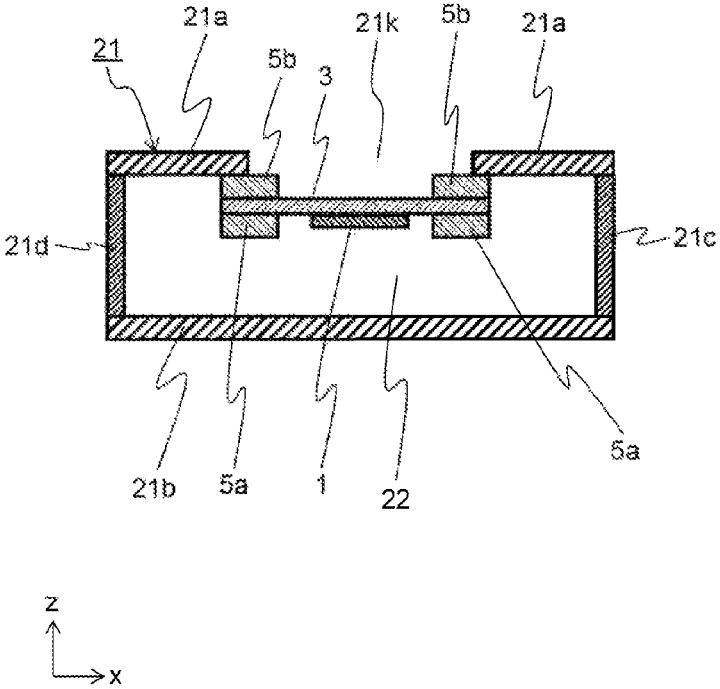
FIG. 2 is a cross-sectional view cut along line A-A' in FIG. 1.
Figure 3:
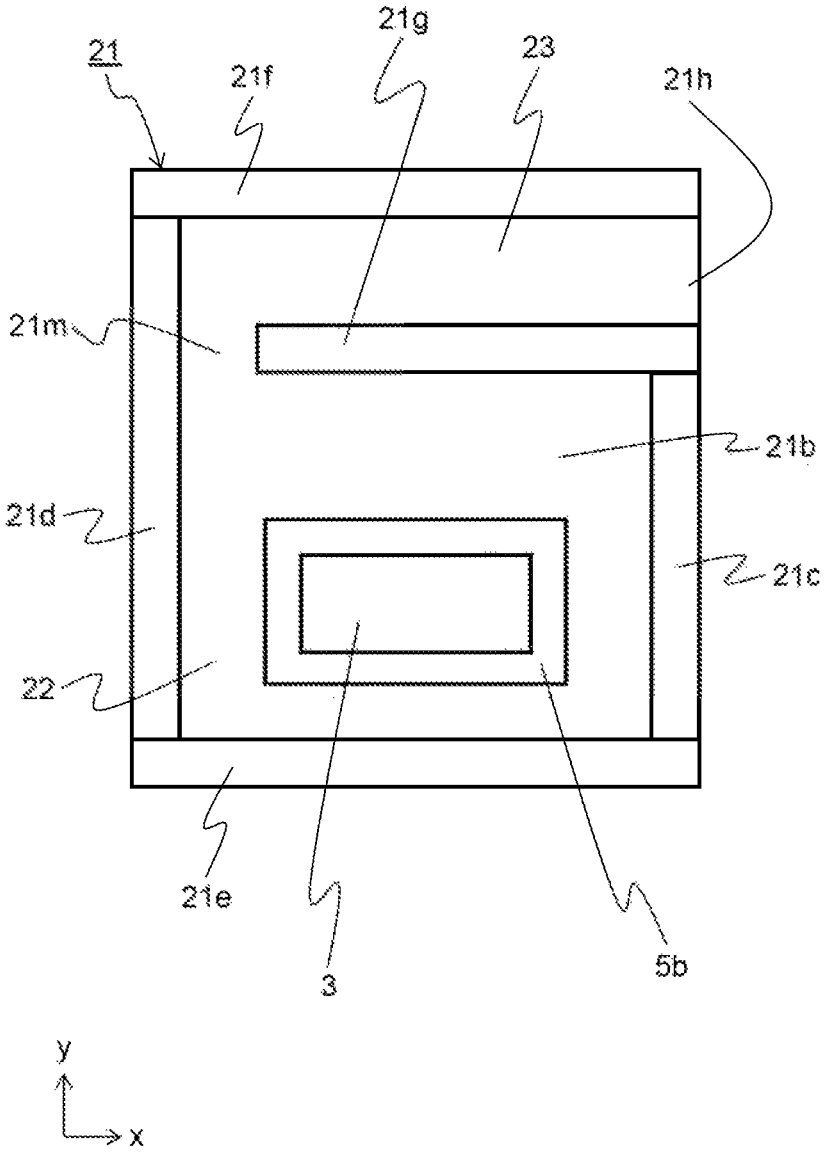
FIG. 3 is a plan view illustrating a state where the sound generator in FIG. 1 is seen through a wall member 21*a*.

FIG. 1 is a perspective view schematically illustrating a sound generator according to a first embodiment of the present invention. FIG. 2 is a cross-sectional view cut along line A-A' in FIG. 1. FIG. 3 is a plan view illustrating a state where the sound generator in FIG. 1 is seen through a wall member 21*a*. In FIGS. 1 to 3, directions are represented by rectangular coordinates in which the x-axis, the y-axis, and the z-axis are orthogonal to each other. As illustrated in FIGS. 1 to 3, the sound generator of the present embodiment includes an exciter 1, vibrating body 3, frames 5*a*, 5*b*, an enclosure 21, a first space 22, and a duct 23.

The vibrating body 3 has a flat shape and more precisely has a film (membrane) shape. The vibrating body 3 is long in the x-axis direction. Specifically, the vibrating body 3 has a flat rectangular shape in which the x-axis direction corresponds to the length direction and the y-axis direction corresponds to the width direction, and the x-axis direction corresponds to the thickness direction. The vibrating body 3 can be formed using various materials. The vibrating body 3 can be formed using, for example, resins such as polyethylene, polyimide, polypropylene, and polystyrene or paper made of pulp, fibers, or the like. The thickness of the vibrating body 3 is, for example, 10 to 200 μm. The vibrating body 3 may have airy shape so long as it has a flat shape, for example, a plate.

The frames 5*a*, 5*b* are each a rectangular frame and have a thickness of, for example, about 0.1 mm to 10 mm. The frames 5*a*, 5*b* are long in the x-axis direction. The x-axis direction corresponds to the length direction, the y-axis direction corresponds to the width direction, and the z-axis direction corresponds to the thickness direction. Although the materials and the shapes of the frames 5*a*, 5*b* are not particularly limited, they are desirably materials and shapes that are less likely to be deformed than those of the vibrating body 3. Specifically, the frames 5*a*, 5*b* desirably have higher rigidity than that of the vibrating body 3. The elastic moduli of the frames 5*a*, 5*b* are desirably larger than that of the vibrating body 3. The frames 5*a*, 5*b* can be formed using, for example, resins such as hard resins, plastics, and engineering plastics, ceramics, or metals such as stainless steel.

The vibrating body 3 is fixed with an adhesive under a tension such that the whole outer edge portion of the rectangle is sandwiched between the frames 5*a*, 5*b*, The vibrating body 3 is vibratably supported by the frames 5*a*, 5*b*. When the frame 5*b* is not included, the vibrating body 3 may be bonded to the surface of the frame 5*a* at the positive side in the z direction. When the frame 5*a* is not included, the vibrating body 3 may be bonded to the surface of the frame 5*b* at the negative side in the z direction.

The exciter 1 is a piezoelectric element and is a rectangular parallelepiped in which the x-axis direction corresponds to the length direction, the y-axis direction corresponds to the width direction, and the z-axis direction corresponds to the thickness direction. In other words, the exciter 1 is long in the x-axis direction. The whole surface of the exciter 1 at the positive side in the z direction is joined to the central portion of the main surface ox the vibrating body 3 at the negative side in the z direction. Although not illustrated in detail in the drawings, the exciter 1 includes a laminate body constituted by alternately laminating piezoelectric body layers formed from piezoelectric ceramics and internal electrode layers, surface electrode layers formed on both of the upper and lower surfaces of the laminate body (both end faces in the z-axis direction), and a pair of terminal electrodes provided on the respective end faces of the laminate body in the lengthwise direction (x-axis direction). The surface electrodes and the internal electrode layers are alternately drawn from both end faces of the laminate body in the lengthwise direction (x-axis direction) and are connected to the corresponding terminal electrodes. Electric signals are added to the pair of terminal electrodes through wiring (not illustrated).

The exciter 1 is a bimorph piezoelectric element. In response to input of an electric signal, expansion and contraction are reversed at a given moment between one side and the other side in the thickness direction (z-axis direction). The exciter 1 thus bends and vibrates in the z-axis direction in response to input of an electric signal. The vibration of the exciter 1 itself causes the vibrating body 3 to bend to vibrate in the z-axis direction. The vibration of the vibrating body 3 then generates sound. In such a manner, the sound generator of the present embodiment generates sound by causing the vibrating body 3 to bend to vibrate and actively utilizing a large number of resonance modes generated toy the vibration of the vibrating body 3.

The exciter 1 may also be, for example, a monomorph vibrating element having a structure in which a piezoelectric element contracting and expanding to vibrate in response to input of an electric signal and a metal plate are bonded together. The main surface of the exciter 1 near the vibrating body 3 is bonded to the vibrating body 3 with, for example, a known adhesive such as an epoxy resin, a silicone resin, or a polyester resin or a double-faced tape.

Conventional piezoelectric ceramics, for example, lead zirconate (PZ), lead zirconium titanate (PZT), or a lead-free piezoelectric body material such as a Si-layered compound and a tungsten bronze structure compound can be used as the piezoelectric body layers of the exciter 1. The thickness of each of the piezoelectric body layers is desirably, for example, about 10 to 100 μm.

Various known metal materials can be used as the internal electrode layers of the exciter 1. For example, although the internal electrode layers can contain a metal component made of silver and palladium and a material component forming the piezoelectric body layers, other materials may also be used to form the internal electrode layers. The surface electrode layers and the terminal electrodes of the exciter 1 can be formed using various known metal materials. For example, although the surface electrode layers and the terminal electrodes can be formed using a material containing a metal component made of silver and a glass component, other materials may also be used to form them.

The outside shape of the enclosure 21 is a box-like rectangular parallelepiped. A plurality of wall members 21*a* to 21*g* each having a rectangular plate shape are joined to form the enclosure 21. More precisely, the wall member 21*a* arranged at the positive side in the z direction faces the wall member 21*b* arranged at the negative side in the z direction with a spacing in the z direction. The four sides at the outer edges of the wall members 21*a*, 21*b* are connected with the wall members 21*c* to 21*f*. In other words, the whole ends of the wall members 21*a*, 21*b* at the positive side in the y direction are connected with each other using the wall member 21*f*. The whole ends of the wall members 21*a*, 21*b* at the negative side in the y direction are connected, with each other using the wall, member 21*e*. The whole ends of the wall members 21*a*, 21*b* at the negative side in the x direction are connected with each other using the wall member 21*d*.

The ends of the wall members 21*a*, 21*b* at the positive side in the x direction, except for the portions of the ends at the positive side in the y direction, are connected with each other using the wall member 21*c*. In other words, although the end of the wall member 21*c* at the negative side in the y direction is connected to the wall member 21*e*, a gap (opening 21*h*) is formed between the end of the wall member 21*c* at the positive side in the y direction and the wall member 21*f*. The opening 21*h* is formed at the side face of the enclosure 21 at the positive side in the x direction and is positioned at the end of the side face at the positive side in the y direction.

The wall member 21*g* that connects between the wall members 21*a*, 21*b* is arranged between the wall members 21*a*, 21*b* such that the wall member 21*g* extends in the x-axis direction. Although the end of the wall member 21*g* at the positive side in the x direction is connected to the end of the wall member 21*c* at the positive side in the y direction, a gap 21*m* is formed between the end of the wall member 21*g* at the negative side in the x direction and the wall member 21*d*. Specifically, the space enclosed with the wall members 21*a* to 21*f* of the enclosure 21 is partitioned with the wall member 21*g* into the space at the positive side in the y direction that is continued to the opening 21*h* and the space at the negative side in the y direction. These two spaces are connected through the gap 21*m*. The space at the positive side in the y direction is smaller than the space at the negative side in the y direction and has a slender shape in the x-axis direction.

A rectangular opening 21*k* is formed in a portion of the wall member 21*a* at the negative side in the y direction apart from a portion to which the wall member 21*g* is joined. The outer edge of the main surface of the vibrating body 3 at the positive side in the z direction is joined to the outer edge of the opening 21*k* at the main surface of the wall member 21*a* at the negative side in the z direction with the frame 5*b* interposed therebetween. In other words, the opening 21*k* is blocked with the vibrating body 3, and the main surface of the vibrating body 3 at the positive side in the z direction is exposed to the external space through the opening 21*k*, The frames 5*a*, 5*b* are not essential. The vibrating body 3 may be directly joined to the outer edge of the opening 21*k* of the wall member 21*a*.

The first space 22 enclosed with the vibrating body 3 and the wall members 21*a*, 21*b*, 21*c*, 21*d*, 21*e*, and 21*g* of the enclosure 21 is formed in such a manner. The duct 23 is formed as the space enclosed with the wall members 21*a*, 21*b*, 21*d*, 21*f*, and 21*g* of the enclosure 21. One end of the duct 23 is connected to the first space 22 through the gap 21*m*, and the other end of the duct 23 is connected to the external space through the opening 21*h*. In other words, the duct 23 connects between the first space 22 and the external space. The duct 23 has a function to change the phase of the sound generated at the surface of the vibrating body 3 at the negative side in the z direction and then emit the sound to the external space. The duct 23 thus desirably has an enough length to change the phase of the sound generated at the surface of the vibrating body 3 at the negative side in the z direction. For example, the duct 23 desirably has a length that is about ¼ or more of the wavelength of the frequency the phase of which needs to be delayed. The volume of the duct 23 is smaller than that of the first space 22.

The enclosure 21 is not limited to a particular shape so long as it can form at least the first space 22 and the duct 23, The enclosure 21 may have any of various scapes, for example, a sphere or a pyramid. The material of the enclosure 21 is also not particularly limited. For example, the enclosure 21 can be formed using a known material such as wood, synthetic resins, metals, glass, and ceramics.

The sound generator of the present embodiment includes at least the vibrating body 3, the exciter 1 that is attached to the vibrating body 3 and bends to vibrate the vibrating body 3 by vibrating itself, the enclosure 21 that is joined to the vibrating body 3 and encloses and forms the first space 22 together with the vibrating body 3, and the duct 23 that is provided at the enclosure 21 and connects between the first space 22 and the external space. This configuration allows the sound generated at the main surface of the vibrating body 3 near the first space 22 to resonate in the first space 22 and discharge the sound to the external space through the duct 23. A sound generator capable of generating sound having high sound pressure in a wide frequency region can be thus obtained.

In the sound, generator of the present embodiment, the spacing between the vibrating body 3 and the surface of the enclosure 21 facing the vibrating body 3 in the z-axis direction, in the first space 22, is smaller than ½ of the length of the wavelength of resonance having the lowest frequency in the bending vibration of the vibrating body 3. This surface is in parallel with the vibrating body 3 of the enclosure 21 and is the surface of the wall member 21*b* at the positive side in the z direction. With this configuration, the frequency of the resonance generated by the multipath reflection of sound between the surface of the enclosure 21 facing the vibrating body 3 and the vibrating body 3 can be put in the frequency range in which the sound generated from the vibrating body 3 has sufficient sound pressure. The resonance generated by the multipath reflection of sound between the surface of the enclosure 21 facing the vibrating body 3 and the vibrating body 3 can be utilized to improve sound pressure in the frequency region used in the sound generator. A sound generator capable of generating sound having high sound pressure can be thus obtained. In the sound generator of the present embodiment, the vibrating body 3 is caused to bend to vibrate. The resonance generated by the bending vibration of the vibrating body 3 is actively utilized, thereby improving the sound pressure. This means that, with, a frequency lower than the frequency of the resonance, which is the lowest frequency in the bending vibration of the vibrating body 3, the sound pressure of the sound generated from the vibrating body 3 significantly decreases. However, the sound generator of the present embodiment includes the above-described configuration. With this configuration, the resonance generated by the multipath reflection of sound between the surface of the enclosure 21 facing the vibrating body 3 and the vibrating body 3 can be utilized with reliability to improve the sound pressure in the frequency region used in the sound generator.

The spacing between the surface of the enclosure 21 facing the vibrating body 3 and the vibrating body 3 is desirably larger than ½ of the upper limit wavelength in the frequency region used in the sound generator. The wavelength of the resonance having the lowest frequency in the bending vibration of the vibrating body 3 can be easily determined by vibration analysis. In the sound generator of the present embodiment illustrated in FIGS. 1 to 3, the vibrating body 3 has a flat rectangular shape. One half of the length of the wavelength of the resonance having the lowest frequency in the bending vibration of the vibrating body 3 thus corresponds to the length of the diagonal line of the rectangle. In most times, the length of the longest portion of the vibrating body 3 where the vibrating body 3 bends to vibrate corresponds to ½ of the length of the wavelength of the resonance having the lowest frequency in the bending vibration of the vibrating body 3.

In the sound generator of the present embodiment, the vibrating body 3 is long in the x-axis direction. In the first space 22, the spacing between the vibrating body 3 and the surface of the enclosure 21 facing the vibrating body 3 in the z-axis direction is smaller than the dimension of the vibrating body 3 in the x-axis direction. This configuration enables the frequency of the standing wave generated between the vibrating body 3 and the wall member 21*b* to exist with reliability in the frequency region used. Sound having high sound pressure can be thus generated in the frequency region used.

The sound generator of the present embodiment generates sound by causing the vibrating body 3 to bend to vibrate and actively utilizing a large number of resonance modes generated by the vibration of the vibrating body 3. Thus, when the spacing between the vibrating body 3 and the wall member 21*b* is reduced, deterioration of acoustic characteristics due to the effect of an air spring is unlikely to occur. Because of this, even when the dimension of the first space 22 in the z-axis direction is smaller than the dimension of the vibrating body 3 in the x-axis direction, the deterioration of the acoustic characteristics can be minimized.

In the sound generator of the present embodiment, the first space 22 and the duct 23 are connected at one end of the first space 22 in the x-axis direction (the length direction of the vibrating body 3). With this configuration, the first space 22 and the duct 23 can be connected at a portion where the amplitude of the standing wave generated in the first space 22 is small. This configuration enables a sound generator having frequency characteristics with flat and favorable sound pressure in which an abrupt increase in sound pressure is reduced in a specific frequency particularly in a low frequency region.

In the sound generator of the present embodiment, the length of the duct 23 is larger than the dimension of the vibrating body 3 in the length direction (x-axis direction). This configuration enables a sound generator capable of generating sound having high sound pressure in a low frequency region. The reason why this effect is obtained is considered to be that the gap 21*m* that is a connecting portion between the first space 22 and the duct 23 serves as an excitation source to generate resonance in the duct 23.

In the sound generator of the present embodiment, the vibrating body 3 and the first space 22 are both long in the x-axis direction, and the length direction of the vibrating body 3 corresponds to the length direction of the first space 22. This configuration enables a sound generator capable of generating sound, having high sound pressure in a low frequency region.

In the sound generator of the present embodiment, the vibrating body 3 is arranged such that in the y-axis direction (the width direction of the vibrating body 3), the central portion of the vibrating body 3 as positioned farther than the central portion of the first space 22 from the gap 21*m* that is the connecting portion between the first space 22 and the duct 23. In brief, in the y-axis direction, the center of the vibrating body 3 is positioned farther than the center of the first space 22 from, the gap 21*m*. This configuration can lower the symmetry in the structure formed of the vibrating body 3 and the first space 22 and can locate the vibrating body 3 away from the gap 21*m*. A sound generator can be thus obtained that have frequency characteristics with flat and favorable sound pressure by lifting the degeneracy of the resonance in the first space 22 and dispersing the resonance peaks and that can generate sound having high sound pressure in a wide frequency region.

The sound generator of the present embodiment can be manufactured, for example, in the following manner. First of all, a binder, a dispersant, a plasticizer, and a solvent are added to powder of a piezoelectric material, and the resultant mixture is kneaded to produce slurry. As the piezoelectric material, any of lead-based and lead-free materials can be used. Subsequently, a green sheet is produced by shaping the slurry into a sheet form. A conductive paste is then printed on the green sheet to form a conductor pattern serving as an internal electrode. Such green sheets on which the conductor pattern is formed are laminated on one another to produce a laminate molded body.

Then, the laminate molded body is degreased, sintered, and cut to have given dimensions so as to provide a laminate body. The outer peripheral portion of the laminate body is processed if necessary. Subsequently, a conductive paste is printed on the main surfaces of the laminate body in the laminate direction to form conductor patterns serving as surface electrode layers. A conductive paste is printed on both side faces of the laminate body in the lengthwise direction (x-axis direction) to form conductor patterns serving as a pair of terminal electrodes. The electrodes are then baked at a given temperature. In this manner, the structure serving as the exciter 1 can be obtained. Thereafter, in order to give piezoelectric properties to the exciter 1, a direct-current voltage is applied thereto through the surface electrode layers or the pair of the terminal electrodes to polarize the piezoelectric body layers of the exciter 1. The exciter 1 can be thus prepared.

Then, the outer edge portion of the vibrating body 3 under a tension is interposed between the frames 5*a*, 5*b* to be joined using an adhesive. The exciter 1 is thus joined to the vibrating body 3 using the adhesive. The frame 5*b* is then joined to the outer edge portion of the opening 21*k* of the wall member 21*a* with an adhesive. Subsequently, the wall members 21*a* to 21*g* are joined with an adhesive to form the enclosure 21. In such a manner, the sound generator of the present embodiment can be produced.

Second Embodiment

Figure 4:
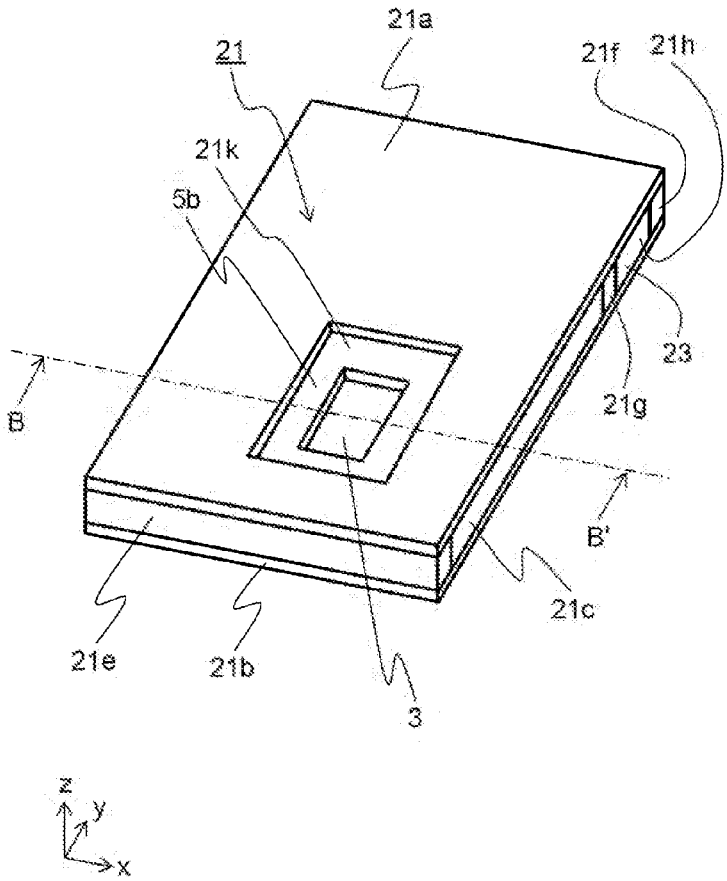
FIG. 4 is a perspective view schematically illustrating a sound generator according to a second embodiment of the present invention.
Figure 5:
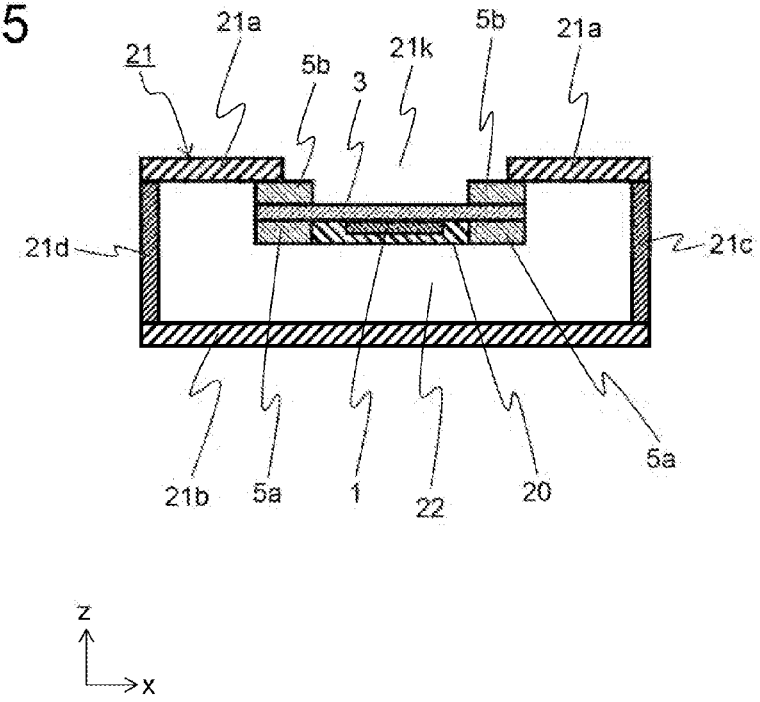
FIG. 5 is a cross-sectional view cut along line B-B' in FIG. 4.
Figure 6:
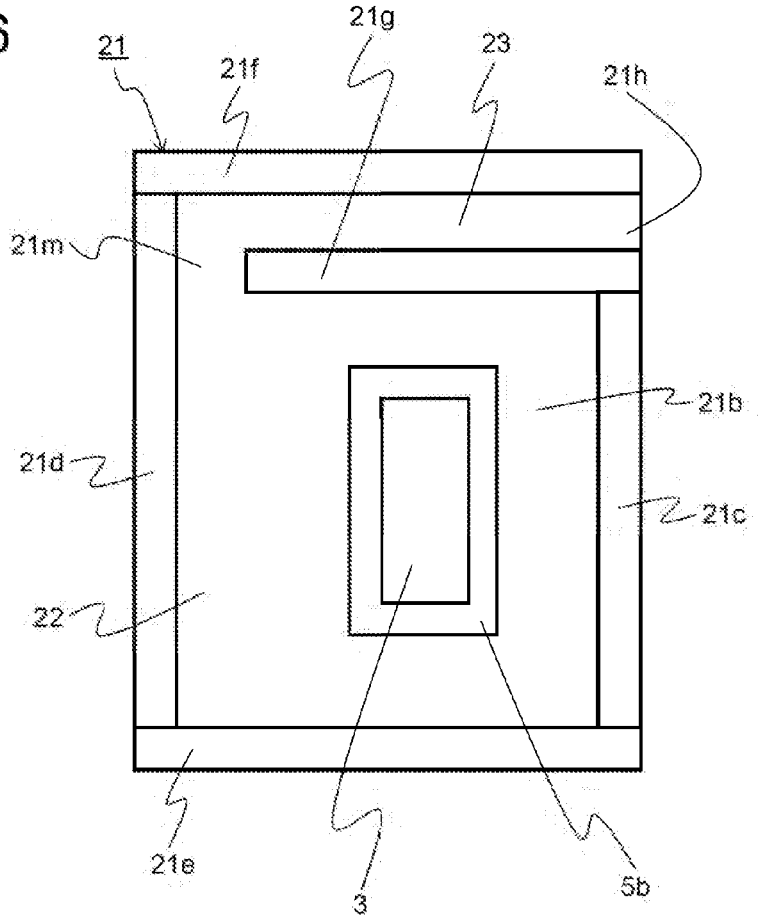
FIG. 6 is a plan view illustrating a state where the sound generator in FIG. 4 is seen through the wall member 21*a*.

FIG. 4 is a perspective view schematically illustrating a sound generator according to a second embodiment of the present invention. FIG. 5 is a cross-sectional view cut along line B-B' In FIG. 4. FIG. 6 is a plan view illustrating a state where the sound generator in FIG. 4 is seen through a wall member 21*a*. In FIGS. 4 to 6, directions are represented by rectangular coordinates 1*a* which the x-axis, the y-axis, and the z-axis are orthogonal to each other. In the present embodiment, only points different from the sound generator in the above-mentioned first embodiment are described, and the same reference signs denote the same constituent components and overlapped description thereof is omitted.

As illustrated in BUGS, 4 to 6, in the sound generator of the present embodiment, the exciter 1, the vibrating body 3, the frames 5*a*, 5*b*, and the first space 22 are long in the y-axis direction. The sound generator of the present embodiment further includes a resin layer 20.

The resin layer 20 fills all over the inner side of the frame 5*a* such that the exciter 1 is buried. The resin layer 20 can be formed using various known materials. For example, resins such as acrylic resins and silicone resins, or rubber can be used. For example, Young's modulus is desirably in a range of 1 MPa to 1 GPa. The thickness of the resin layer 20 is desirably the thickness with which the exciter 1 is completely covered in terms of spurious reduction, but is not limited thereto.

As with the sound generator of the above-mentioned first embodiment, the sound generator of the present embodiment includes the vibrating body 3, the exciter 1, the enclosure 21, the first space 22, and the duct 23. This configuration enables a sound generator capable of generating sound having high sound pressure in a wide frequency region. Since the sound generator of the present embodiment includes the resin layer 20, a sound generator capable of generating greater sound can be obtained by selecting the material and the thickness of the resin layer 20.

In the sound generator of the present embodiment, the vibrating body 3 is long in the y-axis direction. In the first space 22, the spacing between the vibrating body 3 and the surface of the enclosure 21 facing the vibrating body 3 in the z-axis direction is smaller than the dimension of the vibrating body 3 in the y-axis direction. This configuration enables the frequency of the standing wave generated between the vibrating body 3 and the wall member 21*b* to exist in the frequency region used. Sound having high sound pressure can be thus generated in the frequency region used.

In the sound generator of the present embodiment, the first space 22 and the duct 23 axe connected at one end of the first space 22 in the y-axis direction (the length direction of the vibrating body 3). With this configuration, the first space 22 and the duct 23 can be connected at a portion where the amplitude of the standing wave generated in the first space 22 is small. This configuration enables a sound generator having frequency characteristics with flatter and more favorable sound pressure in which resonance peak level is reduced particularly in a low frequency region.

In the sound generator of the present embodiment, the length of the duct 23 is larger than the dimension of the vibrating body 3 in the length direction (y-axis direction). This configuration enables a sound generator capable of generating sound having high sound pressure in a low frequency region. The reason why this effect is obtained is considered to be that the gap 21*m* that is a connecting portion between the first space 22 and the duct 23 serves as an excitation source to generate resonance in the duct 23.

In the sound generator of the present embodiment, the vibrating body 3 and the first space 22 are both long in the y-axis direction, and the length direction of the vibrating body 3 corresponds to the length direction of the first space 22. This configuration enables a sound generator capable of generating sound having high sound pressure in a low frequency region.

In the sound generator of the present embodiment, the vibrating body 3 is arranged such that in the x-axis direction, the central portion of the vibrating body 3 is positioned farther than the central portion of the first space 22 from the gap 21*m* that is the connecting portion between the first space 22 and the duct 23. This configuration can lower the symmetry in the structure formed of the vibrating body 3 and the first space 22 and can locate the vibrating body 3 away from the gap 21*m* that is the connecting portion between the first space 22 and the duct 23. A sound generator can be thus obtained that have frequency characteristics with flat and favorable sound pressure by lifting the degeneracy of the resonance in the first space 22 and dispersing the resonance peaks and that can generate sound having high sound pressure in a wide frequency region.

Third Embodiment

Figure 7:
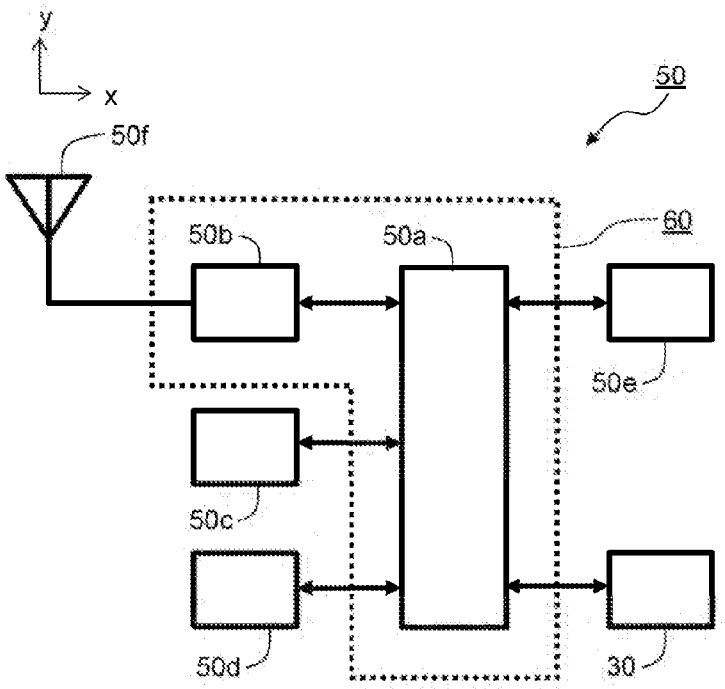
FIG. 7 is a block diagram, illustrating a configuration of an electronic apparatus according to a third embodiment of the present invention.

FIG. 7 is a block diagram illustrating a configuration of an electronic apparatus 50 according to a third embodiment of the present invention. As illustrated in FIG. 7, the electronic apparatus 50 of the present embodiment includes a sound generator 30, an electronic circuit 60, a key input unit 50*c*, a microphone input unit 50*d*, a display unit 50*e*, and an antenna 50*f*. FIG. 7 is a block diagram of an electronic apparatus that is assumed to be, for example, a mobile phone, a tablet terminal, or a personal computer.

The electronic circuit 60 includes a control circuit 50*a* and a communication circuit 50*b*. The electronic circuit 60 is connected to the sound generator 30 and has a function to output a sound signal to the sound generator 30. The control circuit 50*a* is a control unit of the electronic apparatus 50. The communication circuit 50*b*, for example, transmits and receives data through the antenna 50*f* on the basis of the control by the control circuit 50*a*.

The key input unit 50*c* is an input device of the electronic apparatus 50 and accepts a key input operation performed by an operator. The microphone input unit 50*d* is also an input device of the electronic apparatus 50 and accepts a sound input operation performed by an operator. The display unit 50*e* is a display output device of the electronic apparatus 50 and outputs display information on the basis of the control by the control circuit 50*a*.

The sound generator 30 is a sound generator as described in the first and the second embodiments. The sound, generator 30 functions as a sound output device in the electronic apparatus 50. The sound generator 30 generates sound (including sound out of an audible frequency band) in response to a sound signal input from, the electronic circuit 60. The sound generator 30 is connected to the control circuit 50*a* of the electronic circuit 60 and generates sound when a voltage controlled by the control circuit 50*a* is applied thereto.

As described above, the electronic apparatus 50 of the present embodiment includes at least the sound generator 30 and the electronic circuit 60 connected to the sound generator 30 and has a function to generate sound from the sound generator 30. The electronic apparatus 50 of the present embodiment can generate sound having high sound pressure in a wide frequency region because the sound is generated by the sound generator 30 as described in the first and the second embodiments.

As an example of the configuration of the electronic apparatus 50, the housing of the electronic apparatus 50 may include therein the electronic circuit 60, the key input unit 50*c*, the microphone input unit 50*d*, the display unit 50*e*, the antenna 50*f*, and the sound generator 30, which are illustrated in FIG. 7. In this configuration, the opening of the duct of the sound generator 30 is formed to communicate with the external space. As another example of the configuration of the electronic apparatus 50, an apparatus main body including the electronic circuit 60, the key input unit 50*c*, the microphone input unit 50*d*, the display unit 50*e*, and the antenna 50*f*, which are illustrated in FIG. 7, in the housing is connected to the sound generator 30 in such a manner that they can transmit electric signals through a lead wire or the like.

The electronic apparatus of the present embodiment may not necessarily include all of the key input unit 50*c*, the microphone input unit 50*d*, the display unit 50*e*, and the antenna 50*f*, which are illustrated in FIG. 7, and may include at least the sound generator 30 and the electronic circuit 60. The electronic apparatus 50 may also include other constituent components. Furthermore, the electronic circuit 60 is also not limited to the configuration of the electronic circuit 60 described above and may be an electronic circuit having another configuration.

The electronic apparatus of the present embodiment is not limited to the above-mentioned electronic apparatus such as a mobile phone, a tablet terminal, or a personal computer. In various types of electronic apparatuses having a function to generate sound or voice, such as a television, audio equipment, a radio, a vacuum cleaner, a washing machine, a refrigerator, and a microwave oven, the sound generator 30 as described in the first and the second embodiments can be used as a sound generating apparatus.

Modification

The present invention is not limited to the above-mentioned embodiments, and various changes or improvements can be made in a range without departing from a concept of the invention.

For example, although an example in which, a single exciter 1 is attached to the surface of the vibrating body 3 is described in the above-described embodiments so as to simplify the drawings, the embodiments are not limited thereto. For example, a larger number of exciters 1 may also be attached onto the vibrating body 3. Alternatively, for example, the exciter 1 and/or the resin layer 20 may be provided at both surfaces of the vibrating body 3.

Although an example in which a piezoelectric element is used as the exciter 1 is described in the above-described embodiments, the embodiments are not limited thereto. The exciter 1 only has to have a function to change electric signals into mechanical vibration, and other devices having a function to change electric signals into mechanical vibration may also be used as the exciter 1. For example, an electrodynamic exciter, an electrostatic exciter, and an electromagnetic exciter that have been known as exciters vibrating a speaker may be used as the exciter 1. The electrodynamic exciter applies an electric current to a coil arranged between magnetic poles of a permanent magnet to vibrate the coil. The electrostatic exciter applies a bias and an electric signal to two opposing metal plates to vibrate the metal plates. The electromagnetic exciter applies an electric signal to a coil to vibrate a thin iron sheet.

REFERENCE SIGNS LIST

1 Exciter
3 Vibrating body
5*a*, 5*b* Frame
21 Enclosure
22 First space
23 Duct
30 Sound generator
50 Electronic apparatus
60 Electronic circuit

The invention claimed is:

1. A sound generator, comprising:

a vibrating body that has a first direction, a second direction, and a third direction, wherein the first direction, second direction, and third direction are orthogonal to one another, wherein the vibrating body has a shape in which a dimension in the second direction is larger than a dimension in the third direction, and a dimension in the first direction of a thickness direction is smaller than the dimension in the third direction;

an exciter that is attached to the vibrating body and is configured to bend and vibrate the vibrating body in the first direction that is a thickness direction of the exciter by vibrating the exciter itself;

an enclosure that is joined to the vibrating body, the enclosure and the vibrating body forming a first space; and a duct that is provided at the enclosure and is configured to connect between the first space and external space, wherein in the first space, a spacing between the vibrating body and a surface of the enclosure facing the vibrating body in the first direction is smaller than ½ of a length of a wavelength of resonance having the lowest frequency in bending vibration of the vibrating body, and in the third direction, a center of the vibrating body is positioned farther than a center of the first space from a connecting portion between the first space and the duct.

2. The sound generator according to claim 1, wherein the vibrating body is long in the second direction that is perpendicular to the first direction, and in the first space, the spacing between the vibrating body and the surface of the enclosure facing the vibrating body in the first direction is smaller than a dimension of the vibrating body in the second direction.

3. The sound generator according to claim 2, wherein the first space and the duct are connected at one end of the first space in the second direction.

4. The sound generator according to claim 2, wherein a length of the duct is larger than the dimension of the vibrating body in the second direction.

5. The sound generator according to claim 2, wherein the first space is long in the second direction.

6. The sound generator according to claim 3, wherein a length of the duct is larger than the dimension of the vibrating body in the second direction.

7. The sound generator according to claim 3, wherein the first space is long in the second direction.

8. The sound generator according to claim 4, wherein the first space is long in the second direction.

9. An electronic apparatus, comprising:

at least:

the sound generator according to claim 1; and an electronic circuit that is connected to the sound generator, wherein the electronic apparatus is configured to have a function to generate sound from the sound generator.

* * * * *